US006566800B2

(12) United States Patent
Van Der Veeken

(10) Patent No.: US 6,566,800 B2
(45) Date of Patent: May 20, 2003

(54) METHOD OF MANUFACTURING AN ELECTRON GUN

(75) Inventor: Renatus Willem Clemens Van Der Veeken, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 11 days.

(21) Appl. No.: 10/008,110

(22) Filed: Nov. 8, 2001

(65) Prior Publication Data

US 2002/0149310 A1 Oct. 17, 2002

(30) Foreign Application Priority Data

Nov. 30, 2000 (EP) ..... 00204253

(51) Int. Cl.[7] ..... H01J 29/50
(52) U.S. Cl. ..... 313/414; 313/412
(58) Field of Search ..... 313/412, 414, 313/417, 425, 426, 432, 440

(56) References Cited

U.S. PATENT DOCUMENTS 4,678,964 A 7/1987 Peels ..... 313/414
5,052,966 A 10/1991 Van Eck et al. ..... 445/36
5,235,241 A 8/1993 Van Eck et al. ..... 313/414

FOREIGN PATENT DOCUMENTS

EP 0725972 11/1998 ..... H07J/29/46

*Primary Examiner*—Vip Patel

(57) ABSTRACT

A method of manufacturing an electron gun (10) for use in a color display tube (1) is described. The electron gun (10) is provided with an additional electrode (44), positioned between the anode electrode **(21*a*) and the centering cup (23). This additional electrode (44) is part of the beaded unit (29) of the electron gun (10), and this enables very accurate positioning of this additional electrode (44) with regard to its distance to the main focusing section (21) as well as its rotation. This makes it possible to use this additional electrode (44) to improve the quality of the main focusing section (21) by considering it as an integral part of the main focusing section (21). For this reason this additional electrode is referred to as Main lens Field Modifier (MFM) (44). It is shown that by varying the vertical dimension of the apertures (52), (53) of the MFM (44) or the spacing between MFM (44) and main focusing section (21), it is possible to increase the effective lens diameter for spherical aberration, while the effective lens diameter for magnification is kept constant. In other words, the spot performance of the electron gun (10) is improved, while the length of the electron gun (10) is kept unaltered. With a view to obtaining the accuracy needed for a main focusing section (21) with a good tolerance behavior, this new method of manufacturing an electron gun (10)** is of great importance.

11 Claims, 6 Drawing Sheets

METHOD OF MANUFACTURING AN ELECTRON GUN

The invention relates to a method of manufacturing an electron gun for use in a colour display tube, wherein a number of electrodes are beaded by securing them to beading rods to form a beaded unit which sequentially comprises, viewed in the propagation direction of the electrons, a beam forming section and a main focusing section, the main focusing section having a focus electrode and an anode electrode, in a further step a centring cup being coupled to the anode electrode.

The invention further relates to an electron gun for use in a colour display tube, having at least one cathode, a beaded unit comprising, sequentially, viewed in the propagation direction of the electrons, a number of electrodes, having a beam forming section and a main focusing section, the main focusing section having a focus electrode and an anode electrode, the electron gun further comprising a centring cup which is coupled to the anode electrode.

The invention also relates to a colour display tube provided with such an electron gun.

The electron gun as described in the opening paragraph is disclosed in U.S. Pat. No. 4,678,964. In this patent specification an electron gun is described that is provided with a field correction element. This element is connected to the centring cup and this sub-assembly is connected—by welding—to the beaded unit which contains the electrodes of the beam forming section and the main focusing section. The main function of this field correction element is to tune the astigmatism of centre and side beams of the electron gun. Additionally, this field correction element may be used for carrying out convergence corrections.

The electron gun as disclosed in U.S. Pat. No. 4,678,964 has the disadvantage that the manufacturing method for assembling the field correction element lacks the accuracy that is needed for fully utilizing the possibilities of the field correction element. In customary electron guns, the field correction element is a deep drawn part that is welded to the—also deepdrawn—centring cup. Subsequently, this sub-assembly is connected to the anode electrode of the main focusing section by welding them together. This method leads to relatively large positional inaccuracies of the field correction electrode with respect to its distance to the main focusing section and its rotation around the longitudinal axis of the electron gun.

It is an object of the present invention to provide a method of manufacturing an electron gun in which the positional accuracy of the field correction element is significantly improved compared to the electron gun from the prior art.

According to the invention this object is achieved by a method of manufacturing which is characterized in that the main focusing section further comprises an additional electrode positioned in between the anode electrode and the centring cup, which electrode is mounted in the beaded unit.

The invention is based on the recognition that the positional accuracy of the field correction element is greatly improved if, during the manufacturing process, this additional electrode is treated in a similar way as all the other electrodes making up the beam forming section and the main focusing section of the electron gun. This implies that the additional electrode will be part of the beaded unit. During the beading process the electrodes are positioned by stringing them together on centring pins which penetrate the apertures or by providing the electrodes with an outside reference that enables a fixation of the electrodes along their circumference. The spacing between the electrodes is secured by placing spacers between the different electrodes during the beading process, which spacers are removed after the electrodes are secured to each other by the beading rods. This process yields beaded units for electron guns with a very high degree of accuracy regarding the spacing between the different electrodes and the rotation of the individual electrodes.

In a preferred embodiment the additional electrode is electrically connected to the anode electrode.

By connecting the additional electrode to the anode electrode, for instance by interconnecting these two electrodes by means of a small wire or tape, the electron gun can be applied in a similar way as the prior art electron guns, and it does not require an additional voltage for driving the additional electrode.

A further embodiment is characterized in that the additional electrode comprises rectangular apertures.

In practice it has been found that, if the combination of main focusing section and additional electrode is optimized, a simple structure of rectangular apertures for the additional electrode will generally be able to fulfil the requirements.

In a further embodiment, the anode electrode has an apertured plane, and the distance between the additional electrode and the apertured plane of the anode electrode is less than 1.5 mm.

In order to be effective, the additional electrode has to be positioned in the vicinity of the anode electrode, because it has to influence the electric field penetrating the apertures of the anode electrode. In practice, it has been found that the additional electrode loses its effectiveness when the distance to the apertured plane of the anode electrode becomes larger than 1.5 mm.

In a still further embodiment the distance between the additional electrode and the apertured plane of the anode electrode is 0.7 mm.

This distance enables the electric field behind the main focusing section to be influenced in a proper and effective way, while a still smaller distance leads to changes in the electric field of the main focusing section itself. This will deteriorate the characteristics of the main focusing section.

The invention further relates to an electron gun whose properties are obtained by employing the above-described method of manufacturing an electron gun, and to a colour display tube provided with such an electron gun.

These and other aspects of the invention will be apparent from and elucidated by way of non-limitative examples with reference to the drawings and the embodiment(s) described hereinafter.

Figure 1:
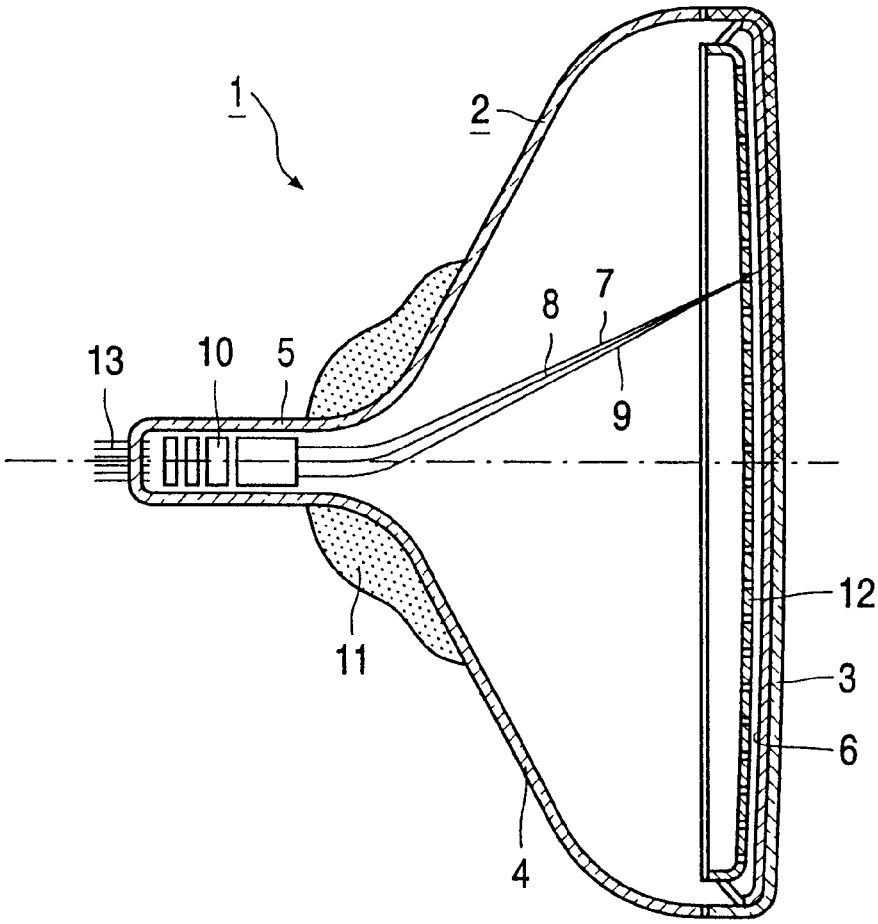
FIG. 1 is a sectional view of a colour display tube.

A colour display tube 1 shown in FIG. 1 comprises an evacuated glass envelope 2 with a display window 3, a funnel shaped part 4 and a neck portion 5. The outer side of the display window 3 can be either curved or flat. On the inner side of the display window 3 a screen 6 having a pattern of for example lines or dots of phosphors luminescing in different colours—e.g. red, green and blue—may be arranged. A shadow mask 12 is positioned at a distance from the screen 6 and may have circular or elongate apertures. During operation of the tube an electron gun 10 arranged in the neck portion 5, and connected via pins 13 to external power supplies, sends electron beams 7, 8, 9 through the shadow mask 12 to the screen 6 so that they impinge on the phosphors that will emit light. The electron beams 7, 8, 9 travel at an angle with respect to each other, thereby ensuring that, at the proper mask to screen distance, the electron beams 7, 8, 9 only impinge on the phosphors of the associated colour. A deflection device 11 ensures that the electron beams 7, 8, 9 systematically scan the screen 6.

The term electron gun should not be construed in a limiting sense. It is not limited to the application in colour display tubes as used to illustrate the present invention. For instance, the invention can also be applied in a monochromatic tube in which the electron gun generates one electron beam only.

Figure 2:
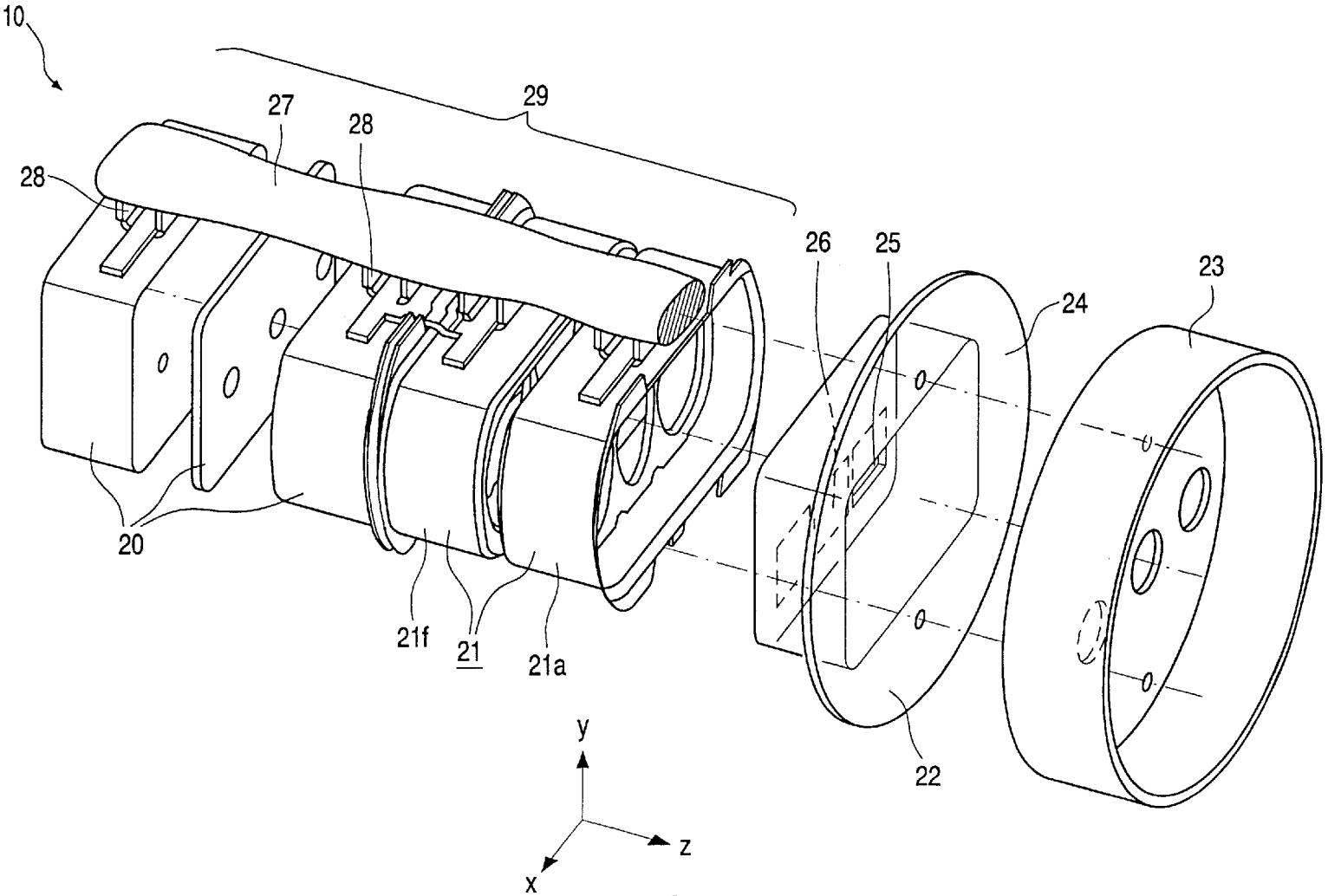
FIG. 2 is a schematic, semi-transparant exploded view of a prior art electron gun.

FIG. 2 is a schematic, exploded view of a prior art electron gun 10. The beam forming section is formed by the electrodes 20, while the main focusing section is formed by the electrodes 21. In this example the beam forming section 20 consists of three electrodes, but this is not of importance to the present invention; other configurations can be used as well. The main focusing section 21 is, in this example, a lens consisting of a focusing electrode 21*f* and an anode electrode 21*a*. During the beading process, the electrodes of the beam forming section 20 and the main focusing section 21 are positioned in a beading jig at prescribed distances from each other. Then they are connected to the beading rods 27 via the brackets 28. The brackets 28 may be an integral part of the electrode or a separate part coupled to the electrodes before the beading process. During this process, the beading rods, generally made from glass, are heated and pressed over the brackets 28. After cooling down, the part of the electron gun 10 that is referred to as the beaded unit 29 is taken from the beading jig. In a next process step the field correction element 22 and the centring cup 23 are mounted on the beaded unit 29. In general, this field correction element 22 is provided with rectangular apertures in the flat portion 24: the aperture 26 for the centre beam and the apertures 25 for the side beams of the electron gun 10. This field correction element is used for adjusting the astigmatism level of the electron gun as described in U.S. Pat. No. 4,678,964. Astigmatism is the difference in lens strength of the main focusing section 21 in the horizontal and the vertical direction. The lens strength of the main focusing section 21 can be expressed as the focusing voltage that is needed to obtain a focused electron spot on the screen 6. Thus, also the astigmatism can be expressed in volts, being the difference between the focusing voltage that is needed to obtain an electron spot that is focused in the horizontal direction and the focusing voltage needed for focusing in the vertical direction.

The field correction element 22 is in general a deep drawn part that is welded to the centring cup 23. Then this subassembly is positioned on the anode electrode 21*a* of the main focusing section 21. This construction is sensitive to tolerances in the production process. The distance from the plane with apertures 25, 26 of the field correction electrode 22 to the main focusing section 21 is not very accurate, because this distance is determined by two deep drawn parts, namely the anode electrode 21*a* and the field correction electrode 22. Furthermore, the rotation of the field correction electrode 22 around the z-axis shows tolerances which are rather large due to the construction in accordance with the prior art. Because the field correction electrode 22 is mainly used for astigmatism corrections in prior art electron guns, this situation is acceptable.

Of course, the electron gun 10 is further provided with cathodes for generating the electron beams 7, 8, 9 that will enter the beam forming section 20. Furthermore, the electron gun 10 is provided with a base containing the pins 13, a certain number of which serves to connect the external power supplies to the electrodes.

Figure 3A:
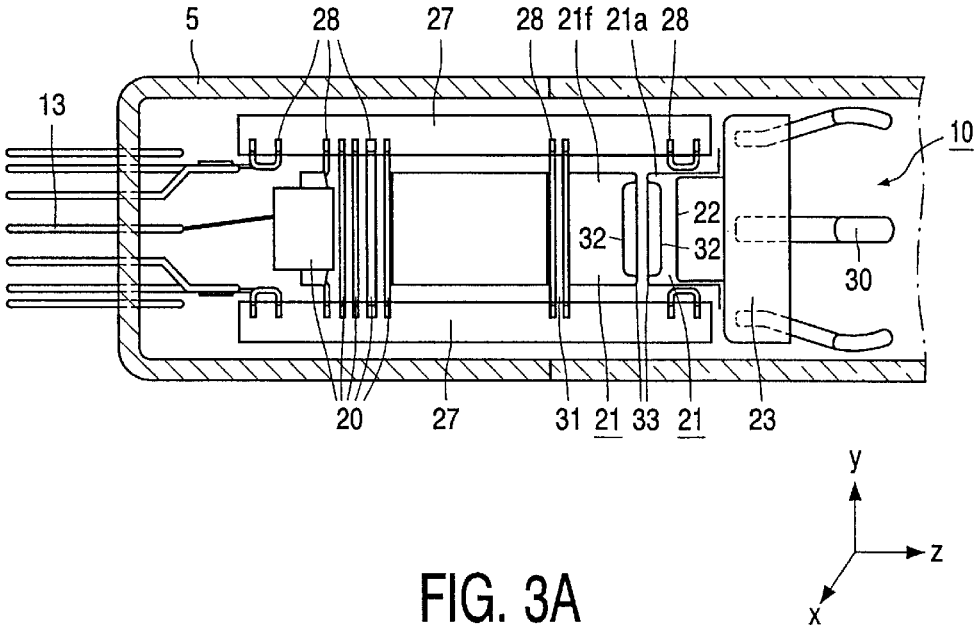
FIGS. 3A and 3B are a side view and a top view, respectively of an electron gun in accordance with the prior art.
Figure 3B:
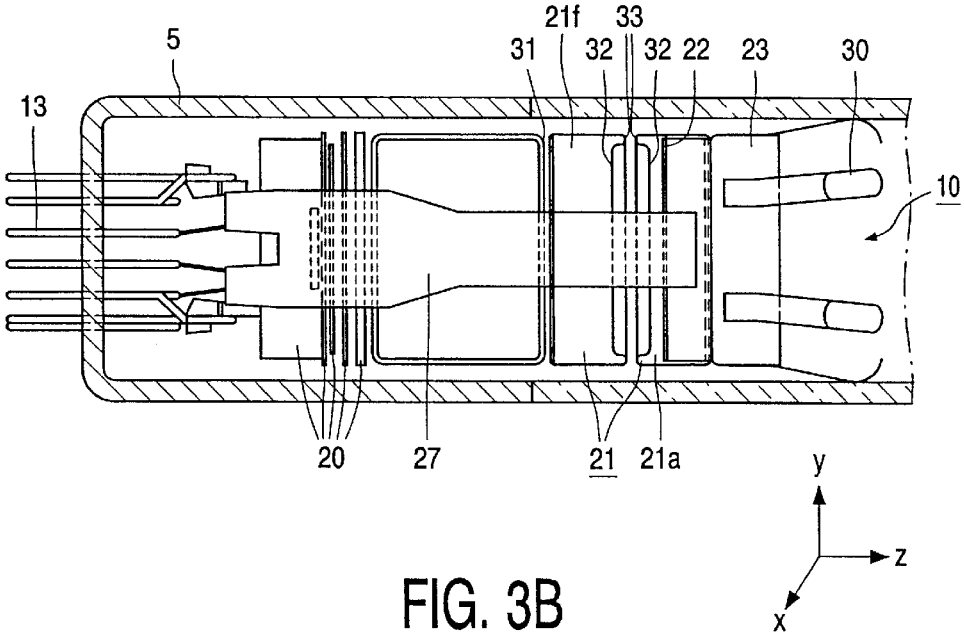

FIG. 3A and FIG. 3B show, respectively, a side view and a top view of an electron gun 10 according to the prior art. This example shows a beam forming section 20 with a plurality of electrodes, but this is irrelevant for the invention. Both main lens electrodes 21*f* and 21*a* have an apertured plane 32 and a rim 33, as can also be seen in FIG. 2. The electron gun of FIGS. 3 may comprise an additional lens 31—for instance a dynamic quadrupole13 in the focusing electrode 21*f*, but this has no consequences for the present invention. This Figure further shows the centring springs 30, connected to the centring cup 23, which take care that the axis of the electron gun 10 substantially coincides with the axis of the colour display tube 1.

Figure 4A:
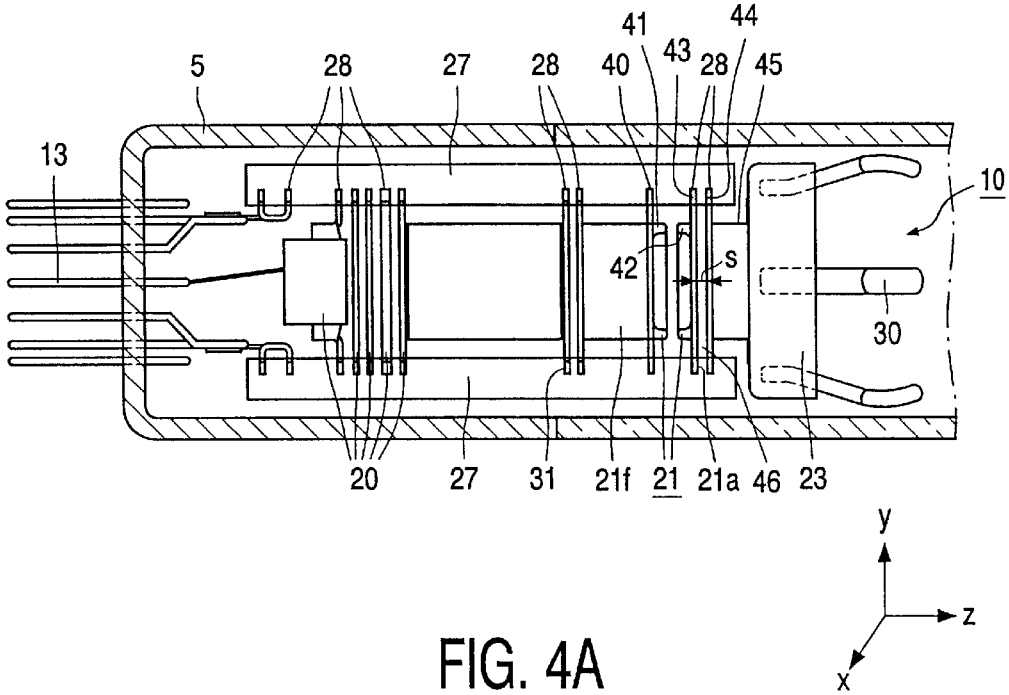
FIGS. 4A and 4B are a side view and a top view, respectively of an electron gun according to the invention.
Figure 4B:
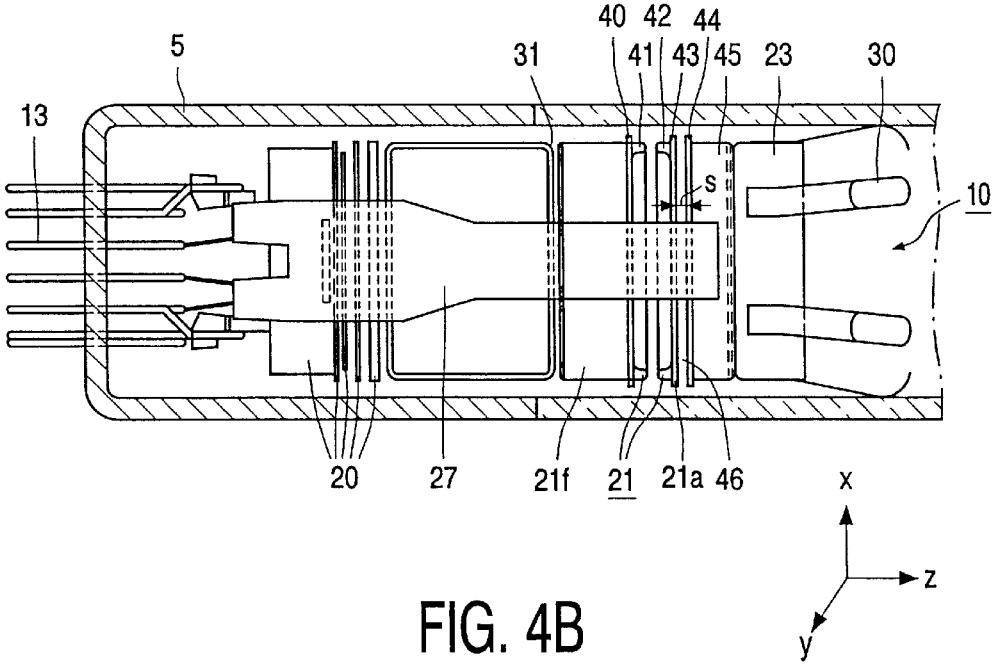
Figure 5:
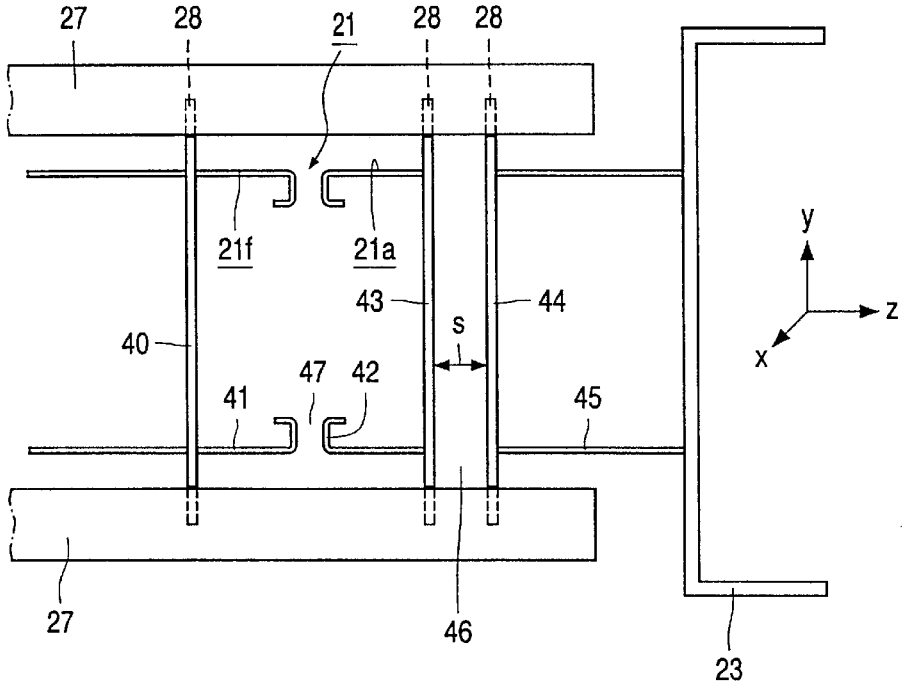
FIG. 5 is a side view of a detail of an electron gun according to the invention.
Figure 6A:
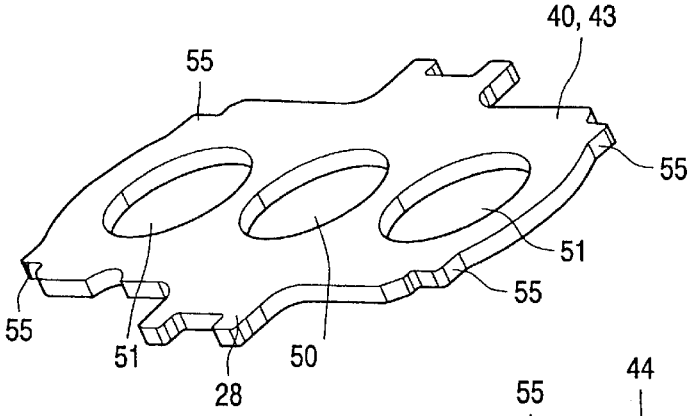
FIGS. 6A and 6B are perspective views of electrodes for use in the main focusing section and in the additional electrode.
Figure 6B:
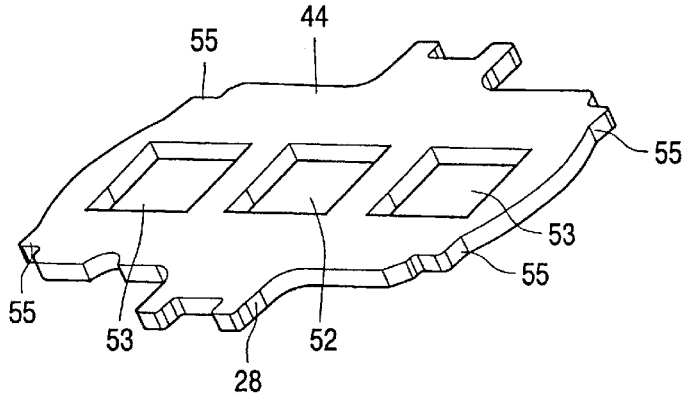

In the FIGS. 4A and 4B, respectively, a side view and a top view are given of an electron gun 10 according to the invention. In this electron gun 10 the construction of the main focusing section 21 and the manufacturing method have been changed. This main focusing section 21 is shown in greater detail in FIGS. 5 and 6A/B. The main focusing section 21 is constructed from two apertured plates 40, 43, which are both provided with a rim-shaped portion 41, 42. The rim-shaped portions 41, 42 are positioned opposite each other, separated by the main lens gap 47. The focusing electrode 21*f* comprises the apertured plate 40 and the rim-shaped portion 41, while the anode electrode 21*a* comprises the apertured plate 43 and the rim-shaped portion 42. The apertured plates 40, 43 contain the brackets for securing these electrodes in the beading rods 28. The apertures 50, 51 in the plates 40 and 43, as shown in FIG. 6A, may be circular, elliptical, oblong or any other convex shape needed to fulfil the main lens requirements, which are a matter of design.

In the electron gun 10 according to the invention, the construction of the additional electrode 44 has been changed. This electrode 44 now is a plate with apertures 52, 53 provided with brackets 28 for the beading process. The apertures 52 and 53 may be rectangular, but also other shapes are possible, like elliptical or oblong. The centring cup 23 may be coupled to the additional electrode 44 by means of a bush 45.

This way of constructing the electron gun 10 enables the additional electrode to be very accurately positioned with respect to the main focusing section 21. The distance s 46 between the apertured plate 43 of the anode electrode 21*f* and the additional electrode 44 is adjusted by using a spacer in between these two electrodes during the beading process. The rotation of the electrode in the plane of the plate 44—the xy-plane—is prevented, for example, by accurately fixing the electrodes during the beading process by means of an outside reference system that uses the projections 55. Such an outside reference system for manufacturing electron guns is disclosed in U.S. Pat. No. 5,052,966 and U.S. Pat. No.

5,235,241. Alternatively, the electrodes can be positioned by using centring pins that penetrate the apertures during the beading process.

The method of manufacturing an electron gun 10 according to the invention enables a very accurate positioning of the main focusing section 21 including the additional electrode 44. This makes it possible to fully exploit the additional electrode 44 for improving the characteristics of the main focusing section 21, which is a big improvement over the prior art. The poor positional accuracy of the additional electrode 22 in prior art electron guns limits its use to that of field correction element, which only adjusts the astigmatism level. According to the invention, the additional electrode 44 becomes an integral part of the design of the main focusing section 21 and for that reason it will be further referred to as the Main lens Field Modifier (MFM).

Traditionally, the additional electrode 22 is provided with the same voltage as the anode electrode 21*a*. The new construction of the MFM 44 also makes it possible to provide this electrode with a voltage that is different from that on the anode electrode 21*a*. This may, for instance, be achieved by providing the electron gun 10 with an internal voltage divider.

In order to illustrate the possibilities that arise by making use of the invention, it will be shown that by integrally optimizing the combination of the main focusing section 21 and the additional electrode or MFM 44, an electron gun 10 with an improved lens quality or a shorter electron gun with the same lens quality can be obtained.

The quality of a main focusing section 21 is governed by its effective lens diameter. Apart from the physical lens diameter—the size of the apertures in the plates 40 and 43 of the main lens electrodes—two effective lens diameters can be calculated. The first one is the effective lens diameter for magnification, denoted by Dm. This lens diameter determines the magnification of the main focusing section 21 and hence the focusing voltage. This is a direct measure of the length of the electron gun 10. The second one is the lens diameter for spherical aberration, denoted by Dsa, determining the quality of the electron spot on the screen 6 and hence the resolution of the colour display tube 1.

In prior art electron guns the length of the electron gun 10 was always directly linked with the quality of the main focusing section 21. Increasing the length of the electron gun 10 will lower the magnification of the main focusing section 21, resulting in a higher focusing voltage, a weaker main focusing section 21 and hence a lower spherical aberration. This results in a better spot performance of the colour display tube 1 and hence in a better resolution.

This invention breaks with the tradition that there is always a link between the effective lens diameters for magnification and spherical aberration. It will be shown that an electron gun 10 can be designed so as to have an improved Dsa at a constant Dm, or in other words: an electron gun 10 with an improved resolution at the same gun length and at the same focusing voltage.

By way of example an electron gun has been calculated. This example describes an electron gun 10 with a main focusing section 21, the construction of which is analogous to that of the main focusing section 21 shown in FIG. 5. The separation between the electron beams—that is the distance between the centre beam 8 and the side beams 7, 9—is 6.5 mm. This main foousing section 21 is referred to as CFL 6.5 (Composed Field Lens with a pitch of 6.5 mm). Calculations were carried out at a fixed voltage on the anode electrode 21*a* of 30 kV and a fixed voltage on the focusing electrode 21*f* of 8.19 kV. Furthermore, the main lens gap 47 is fixed at 1.1 mm.

In the optimization procedure, two parameters of the Main lens Field Modifier 44 were varied. First, the distance s 46 between the MFM 44 and the apertured plate 43 of the anode electrode 21*a*, the apertures 52, 53 in the MFM 44 being kept constant at 5.5 mm in the horizontal direction and 4.0 mm in the vertical direction. Secondly, the vertical dimension of the apertures 52, 53 in the MFM 44, keeping the horizontal dimensions constant at 5.5 mm, and the spacing s 46 being 1.5 mm. At a given choice of these parameters, the apertures in the apertured plates 40, 43 are calculated so as to render a main focusing section 21 that fulfils the requirements. These requirements are, for instance, substantially equal focusing conditions and astigmatism levels for centre and side beams. The results are given in Tables 1 and 2 respectively; the given lens diameters, Dm,x and Dsa,x, are for the horizontal direction only, because the vertical direction is of less importance for the spot performance.

TABLE 1

Variation of the spacing s at constant aperture size (5.5 * 4.0 $mm^2$) in the MFM

| | Dm,x | | | | Dsa,x | | | |
|---|---|---|---|---|---|---|---|---|
| Spacing s (mm) | Centre (mm) | side (mm) | average (mm) | relative (%) | centre (mm) | side (mm) | average (mm) | Relative (%) |
| 0.7 | 6.97 | 6.91 | 6.94 | 99 | 7.89 | 7.82 | 7.86 | 108 |
| 0.8 | 6.99 | 6.94 | 6.97 | 99 | 7.79 | 7.78 | 7.79 | 107 |
| 1.05 | 6.97 | 6.94 | 6.96 | 99 | 7.48 | 7.57 | 7.53 | 103 |
| 1.5 | 7.02 | 7.00 | 7.01 | 100 | 7.19 | 7.36 | 7.28 | 100 |

TABLE 2

Variation of vertical dimension in the MFM with spacing s = 1.5 mm.

| | Dm,x | | | | Dsa,x | | | |
|---|---|---|---|---|---|---|---|---|
| Vertical dimension (mm) | Centre (mm) | side (mm) | average (mm) | relative (%) | centre (mm) | side (mm) | average (mm) | Relative (%) |
| 3.5 | 6.96 | 6.95 | 6.96 | 99 | 7.45 | 7.52 | 7.49 | 108 |
| 4.0 | 7.02 | 7.00 | 7.01 | 100 | 7.19 | 7.36 | 7.28 | 105 |
| 4.5 | 6.99 | 6.97 | 6.98 | 100 | 6.98 | 7.12 | 7.05 | 102 |
| 5.0 | 7.01 | 6.99 | 7.00 | 100 | 6.75 | 7.07 | 6.91 | 100 |

Figure 7:
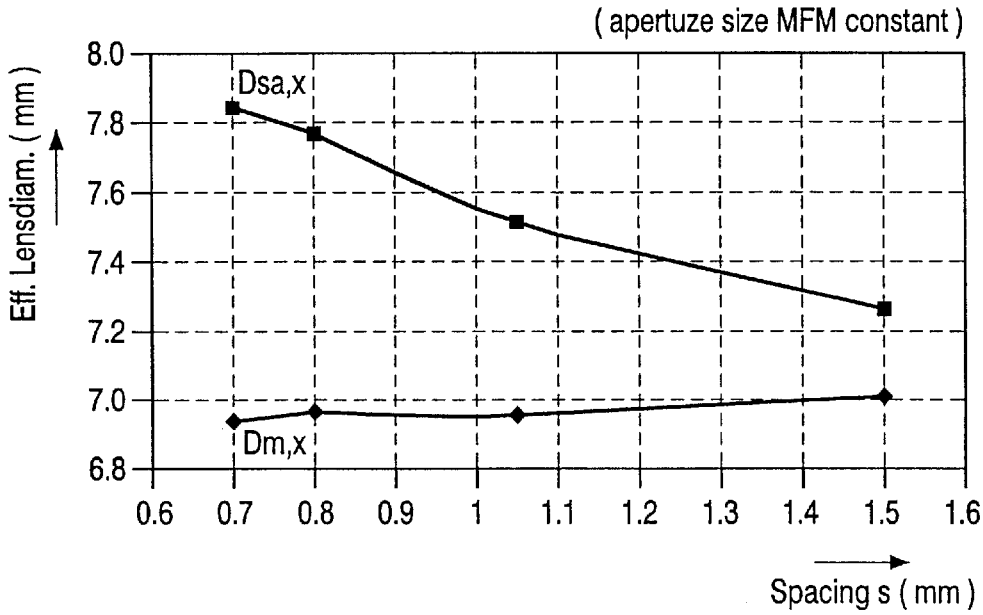
FIG. 7 is a graphic representation of the effective lens diameter as a function of the spacing between the additional electrode and the anode electrode.
Figure 8:
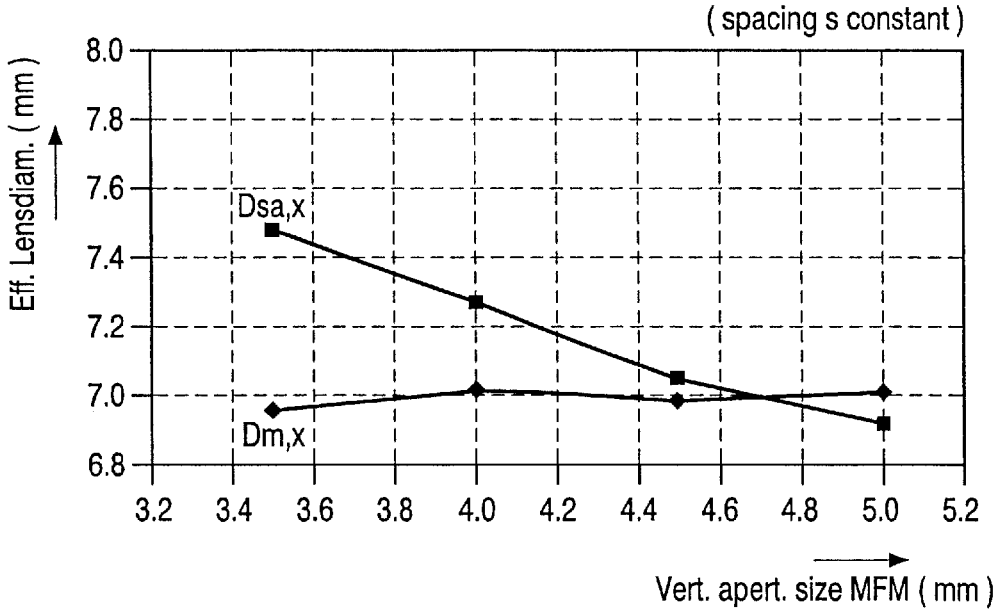
FIG. 8 is a graphic representation of the effective lens diameter as a function of the vertical aperture dimension of the additional electrode.

These Tables show that by varying the spacing s 46 or the vertical dimension of the apertures 52, 53, it is possible to design a main focusing section 21 that, on the one hand, keeps the effective lens diameter for magnification substantially constant at about 7 mm and, on the other hand, leads to an improvement of the effective lens diameter for spherical aberration by about 8% for both variations. Thus, decreasing the spacing s from 1.5 to 0.7 mm leads to an 8% improvement—in terms of spherical aberration—and so does decreasing the vertical dimension of the apertures 52, 53 from 5.0 to 3.5 mm. The results shown in Tables 1 and 2 are graphically displayed in the FIGS. 7 and 8, respectively.

This example shows that an integral design of main focusing section 21 and MFM 44 leads to an electron gun 10 with an improved spot performance, i.e. larger effective lens diameter for spherical aberration, at a constant length of the electron gun 10, i.e. the same effective lens diameter for magnification. Of course, this phenomenon can also be applied for obtaining a shorter gun with the same spot performance; in that situation the focusing voltage will be lower and the focusing action of the main focusing section 21 will be stronger.

The invention describes a generic way of improving the spot performance of a colour display tube 1 by integrally designing the combination of main focusing section 21 and MFM 44. This is not restricted to the examples given above. The invention is also applicable to all kinds of other main lens systems, like a distributed main lens as disclosed in EP-B-0725972.

In summary, a method of manufacturing an electron gun 10 for use in a colour display tube 1 is described. The electron gun 10 is provided with an additional electrode 44, positioned between the anode electrode 21*a* and the centring cup 23. This additional electrode 44 is part of the beaded unit 29 of the electron gun 10, and this enables very accurate positioning of this additional electrode 44 with regard to its distance to the main focusing section 21 as well as its rotation. This makes it possible to use this additional electrode 44 to improve the quality of the main focusing section 21 by considering it as an integral part of the main focusing section 21. For this reason this additional electrode is referred to as Main lens Field Modifier (MFM) 44.

It is shown that by varying the vertical dimension of the apertures 52, 53 of the MFM 44 or the spacing between MFM 44 and main focusing section 21, it is possible to increase the effective lens diameter for spherical aberration, while the effective lens diameter for magnification is kept constant. In other words, the spot performance of the electron gun 10 is improved, while the length of the electron gun 10 is kept unaltered. With a view to obtaining the accuracy needed for a main focusing section 21 with a good tolerance behaviour, this new method of manufacturing an electron gun 10 is of great importance.

What is claimed is:

1. An electron gun (10) for use in a colour display tube (1), having at least one cathode, a beaded unit (29) comprising, sequentially, viewed in the propagation direction of the electrons, a number of electrodes, having a beam forming section (20) and a main focusing section (21), the main focusing section (21) having a focus electrode (21*f*) and an anode electrode (21*a*), the electron gun (10) further comprising a centring cup (23) which is coupled to the anode electrode (22*a*), characterized in that the main focusing section (21) further comprises an additional electrode (44) positioned in between the anode electrode (21*a*) and the centring cup (23), which additional electrode (44) is mounted in the beaded unit (29).

2. An electron gun (10) as claimed in claim 1, characterized in that the additional electrode (44) is electrically connected to anode electrode (21*f*).

3. An electron gun (10) as claimed in claim 1, characterized in that the additional electrode (44) comprises rectangular apertures (52), (53).

4. An electron gun (10) as claimed in claim 1, further comprising an anode electrode (21*a*) having an apertured plane (43), characterized in that the distance s (46) between the additional electrode (44) and the apertured plane (43) of the anode electrode (21*a*) is smaller than 1.5 mm.

5. An electron gun (10) as claimed in claim 4, characterized in that the distance s (46) between the additional electrode (44) and the apertured plane (43) of the anode electrode (21*a*) is 0.7 mm.

6. A colour display tube (1) provided with the electron gun (10) as claimed in claim 1.

7. A method of manufacturing an electron gun (10) for use in a colour display tube (1), wherein a number of electrodes (20,21) are beaded by securing them to beading rods (27) to form a beaded unit (29) which sequentially comprises, viewed in the propagation direction of the electrons, a beam forming section and a main focusing section (21), the main focusing section (21) having a focus electrode (21*f*) and an anode electrode (21*a*), in a further step a centring cup (23) being coupled to the anode electrode (21*a*), characterized in that the main focusing section (21) further comprises an additional electrode (44) positioned in between the anode electrode (21*a*) and the centring cup (23), which additional electrode (44 is mounted in the beaded unit (29).

8. A method of manufacturing an electron gun (10) as claimed in claim 7, characterized in that the additional electrode (44) is electrically connected to anode electrode (21*a*).

9. A method of manufacturing an electron gun (10) as claimed in claim 7, characterized in that the additional electrode (44) comprises rectangular apertures (52, 53).

10. A method of manufacturing an electron gun (10) as claimed in claim 7, further comprising an anode electrode (21*a*) having an apertured plane (43), characterized in that the distance s (46) between the additional electrode (44) and the apertured plane of the anode electrode (43) is smaller than 1.5 mm.

11. A method of manufacturing an electron gun (10) as claimed in claim 10, characterized in that the distance s (46) between the additional electrode (21) and the apertured plane of the anode (43) electrode is 0.7 mm.

* * * * *